US009255773B1

(12) United States Patent
Hall

(10) Patent No.: US 9,255,773 B1
(45) Date of Patent: Feb. 9, 2016

(54) TARGET HOLDER

(71) Applicant: Thomas Hall, Old Saybrook, CT (US)

(72) Inventor: Thomas Hall, Old Saybrook, CT (US)

(73) Assignee: Thomas Hall, Old Saybrook, CT (US)

( * ) Notice: Subject to any disclaimer, the term of this patent is extended or adjusted under 35 U.S.C. 154(b) by 212 days.

(21) Appl. No.: 13/839,290

(22) Filed: Mar. 15, 2013

(51) Int. Cl.
*F41J 1/10* (2006.01)
*F41J 7/00* (2006.01)

(52) U.S. Cl.
CPC ..... *F41J 1/10* (2013.01); *F41J 7/00* (2013.01)

(58) Field of Classification Search
CPC ..... F41J 1/00; F41J 1/10; F41J 7/00
USPC ..... 273/403–410, 390–392, 371
See application file for complete search history.

(56) References Cited

U.S. PATENT DOCUMENTS

| | | | | | |
|---|---|---|---|---|---|
| 398,186 | A | | 2/1889 | Rehfuss | |
| 1,482,725 | A | | 11/1923 | Bechtol et al. | |
| 1,981,293 | A | | 6/1933 | Varrelman | |
| 1,928,768 | A | * | 10/1933 | Sell et al. | 273/409 |
| 2,034,839 | A | * | 3/1936 | Sheffield | 273/382 |
| 2,048,155 | A | * | 7/1936 | Armantrout | 273/407 |
| 2,231,640 | A | | 2/1941 | Rubin | |
| 2,466,686 | A | * | 4/1949 | Connelly | 226/43 |
| 3,519,272 | A | * | 7/1970 | De Vogelaere | 273/404 |
| 3,893,336 | A | * | 7/1975 | Tucker | 73/167 |
| 4,247,116 | A | * | 1/1981 | McQuary | 273/394 |
| 4,317,572 | A | | 3/1982 | Iseli | |
| 4,361,330 | A | | 11/1982 | Scharer | |
| 4,523,761 | A | * | 6/1985 | Huscher | 273/371 |
| 4,548,414 | A | * | 10/1985 | Denis | 273/367 |
| 4,583,744 | A | * | 4/1986 | Tolliver et al. | 273/404 |
| 5,031,920 | A | * | 7/1991 | Poirier | 273/371 |
| 5,169,157 | A | * | 12/1992 | Salmon | 273/407 |
| 5,829,753 | A | * | 11/1998 | Wiser | 273/407 |
| 5,974,263 | A | * | 10/1999 | Meschter et al. | 396/6 |
| 6,257,584 | B1 | | 7/2001 | Nasuti | |
| 6,543,778 | B2 | | 4/2003 | Baker | |
| 7,374,173 | B2 | * | 5/2008 | Nasuti | 273/407 |
| 7,784,794 | B2 | * | 8/2010 | Sitton | 273/348 |
| 8,141,878 | B2 | * | 3/2012 | Kuyl | 273/403 |
| 8,910,944 | B2 | * | 12/2014 | Mason, III | 273/407 |
| 2008/0211190 | A1 | * | 9/2008 | Smith | 273/407 |
| 2011/0175293 | A1 | * | 7/2011 | Brune | 273/406 |

* cited by examiner

*Primary Examiner* — Mark Graham
(74) *Attorney, Agent, or Firm* — Robert Curcio; DeLio, Peterson & Curcio, LLC

(57) ABSTRACT

A target holder comprising a frame including a vertical frame assembly and a horizontal frame assembly connected to a bottom portion of the vertical frame assembly. The target holder includes a supply roll assembly disposed along a top portion of the vertical frame assembly, a motor support disposed on the vertical frame assembly below the supply roll assembly and a motor having a rotatable drive shaft, the motor fastened to the motor support assembly. The target holder includes a take-up roll assembly rotatingly engaged with the drive shaft and target roll rotatingly disposed on the supply roll assembly, the target roll including a plurality of targets. The target holder may include a motor control circuit for controlling the operation of the motor, remote receiver in communication with the motor control circuit and a remote transmitter for transmitting a signal to the remote receiver.

14 Claims, 8 Drawing Sheets

TARGET HOLDER

BACKGROUND OF THE INVENTION

1. Field of the Invention

The present invention relates to target holders and specifically to target holders having a targets which may be remotely replaced.

2. Description of Related Art

Target holders or target stands typically include taped or stapled paper targets. Replacement corrugated boards may be used for weather resistance. Once the target is used, the person firing ammunition at the target must approach the target, remove the target and then replace the used target with a new target, either by taping or stapling the target to the holder. If multiple people are practicing at one time, the user of the stand must wait for all other users to finish in order to approach the target holder.

SUMMARY OF THE INVENTION

Bearing in mind the problems and deficiencies of the prior art, it is therefore an object of the present invention to provide a target holder which automatically changes targets without having to approach the target holder.

It is another object of the present invention to provide a target holder for target shooting at long-range.

A further object of the invention is to provide a target holder which has the ability to be leveled when the target holder is placed on unlevel ground.

It is yet another object of the present invention to provide a target holder which receives a remote signal for changing targets on the target holder.

Still other objects and advantages of the invention will in part be obvious and will in part be apparent from the specification.

The above and other objects, which will be apparent to those skilled in the art, are achieved in the present invention which is directed to a target holder comprising a frame including a vertical frame assembly and a horizontal frame assembly connected to a bottom portion of the vertical frame assembly. The target holder includes a supply roll assembly disposed along a top portion of the vertical frame assembly, a motor support disposed on the vertical frame assembly below the supply roll assembly and a motor having a rotatable drive shaft, the motor fastened to the motor support assembly. The target holder includes a take-up roll assembly rotatingly engaged with the drive shaft and a target roll rotatingly disposed on the supply roll assembly, the target roll including a plurality of targets.

The target holder may include a motor control circuit connected to the motor, the motor control circuit controlling operation of the motor. The target holder may include a remote receiver and a remote transmitter, the remote receiver in communication with the motor control circuit and receiving a signal transmitted by the remote transmitter. Each of the targets may include an indicator mark disposed thereon and the motor control circuit includes an optical sensor sensing the position of the indicator mark. The target may be advanced forward with the optical sensor causes termination of roll advancement when the indicator mark is adjacent to the optical sensor. The target holder may include a camera capturing a visual image of at least one target and transmitting the visual image signal to a display The frame may include a level adjustment assembly having a horizontal adjustment disk attached along the horizontal assembly and a vertical adjustment disk assembly attached along the vertical frame assembly. The vertical adjustment disk may have a first set of teeth along the perimeter of the vertical adjustment disk and the horizontal adjustment disk may have a second set of teeth along the perimeter of the horizontal adjustment disk, the second set of teeth engagable with the first set of teeth whereby the vertical frame assembly is angularly adjustable in relation to the horizontal frame assembly.

The motor support assembly may include a motor bracket attached to the vertical frame assembly, the motor bracket including a pair of opposing side brackets having bracket openings. The supply roll assembly may include a clutch for providing rotational resistance to the supply roll.

The target roll may have a width and horizontal perforations extending across the width between adjacent targets, the horizontal perforations allowing a user to separate at least one of the plurality of targets from the target roll. The target holder may include a tab disposed on the target roll and an elongated slot disposed on the take-up roll, the tab engagable with the elongated slot for allowing a user to insert the tab into the elongated slot during set up of the target holder. The target roll may have a width and tab perforations extending across the width between adjacent targets, the tab perforations allowing a user to separate at least one of the plurality of targets from the target roll while leaving a tab on the target roll, the tab insertable into the elongated slot of the take-up roll.

Another aspect of the present invention is directed to a method for using a target holder comprising providing a target holder having a frame, a target supply roll disposed on the frame, a motor disposed on the frame a distance from the supply roll, the motor having a rotatable drive shaft, a take-up roll rotatingly engaged with the motor drive shaft and a target roll rotatingly disposed on the supply roll, the target roll including a plurality of targets. The method includes ensuring one of the plurality of targets is disposed between the supply roll assembly and the take-up roll assembly and firing at least one round of ammunition toward the target. The method includes commencing operation of the motor to rotate the take-up roll and advance to a second of a plurality of targets.

The step of commencing operation of the motor may include providing an electrical signal to commence rotation of the motor drive shaft, the rotation of the motor drive shaft terminating when the second target is disposed between the supply roll assembly and the take-up roll. The method may include providing a remote receiver and a remote transmitter, the remote receiver in communication with the motor control circuit and receiving a signal transmitted by the remote transmitter and depressing a button on the remote transmitter to send a signal to the remote receiver, commencing the operation of the motor.

Each of the targets may include an indicator mark disposed thereon and the motor control circuit may include an optical sensor sensing the position of the indicator mark. The step of commencing operation of the motor may be followed by the step of allowing the optical sensor to sense the indicator mark on a second of the plurality of targets causing the motor drive shaft to stop rotating.

BRIEF DESCRIPTION OF THE DRAWINGS

The features of the invention believed to be novel and the elements characteristic of the invention are set forth with particularity in the appended claims. The figures are for illustration purposes only and are not drawn to scale. The invention itself, however, both as to organization and method of operation, may best be understood by reference to the detailed description which follows taken in conjunction with the accompanying drawings in which:

DESCRIPTION OF THE PREFERRED EMBODIMENT(S)

In describing the preferred embodiment of the present invention, reference will be made herein to FIGS. 1-13 of the drawings in which like numerals refer to like features of the invention.

Figure 1:
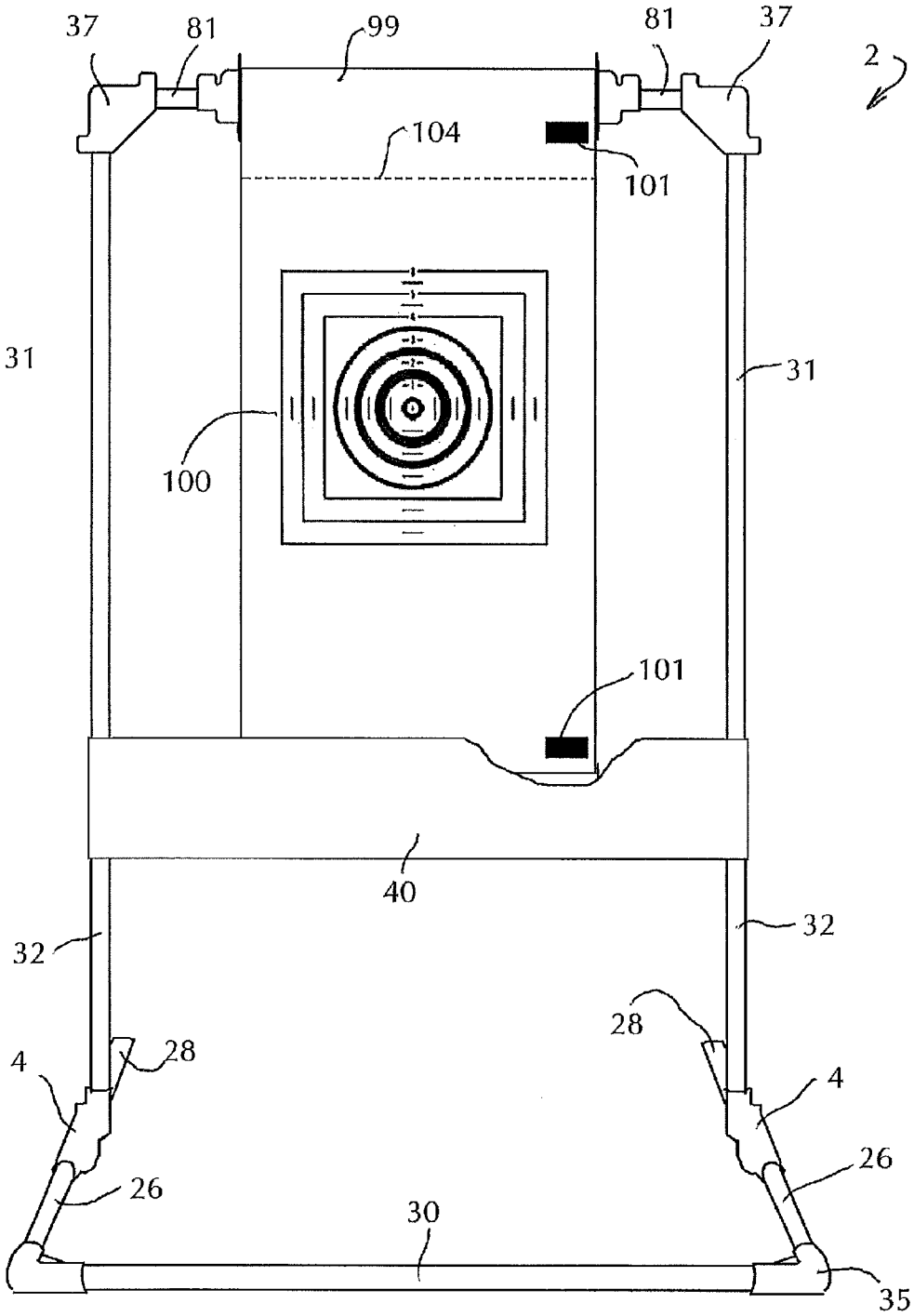
FIG. 1 is a front perspective view of the target holder according to the present invention.
Figure 2:
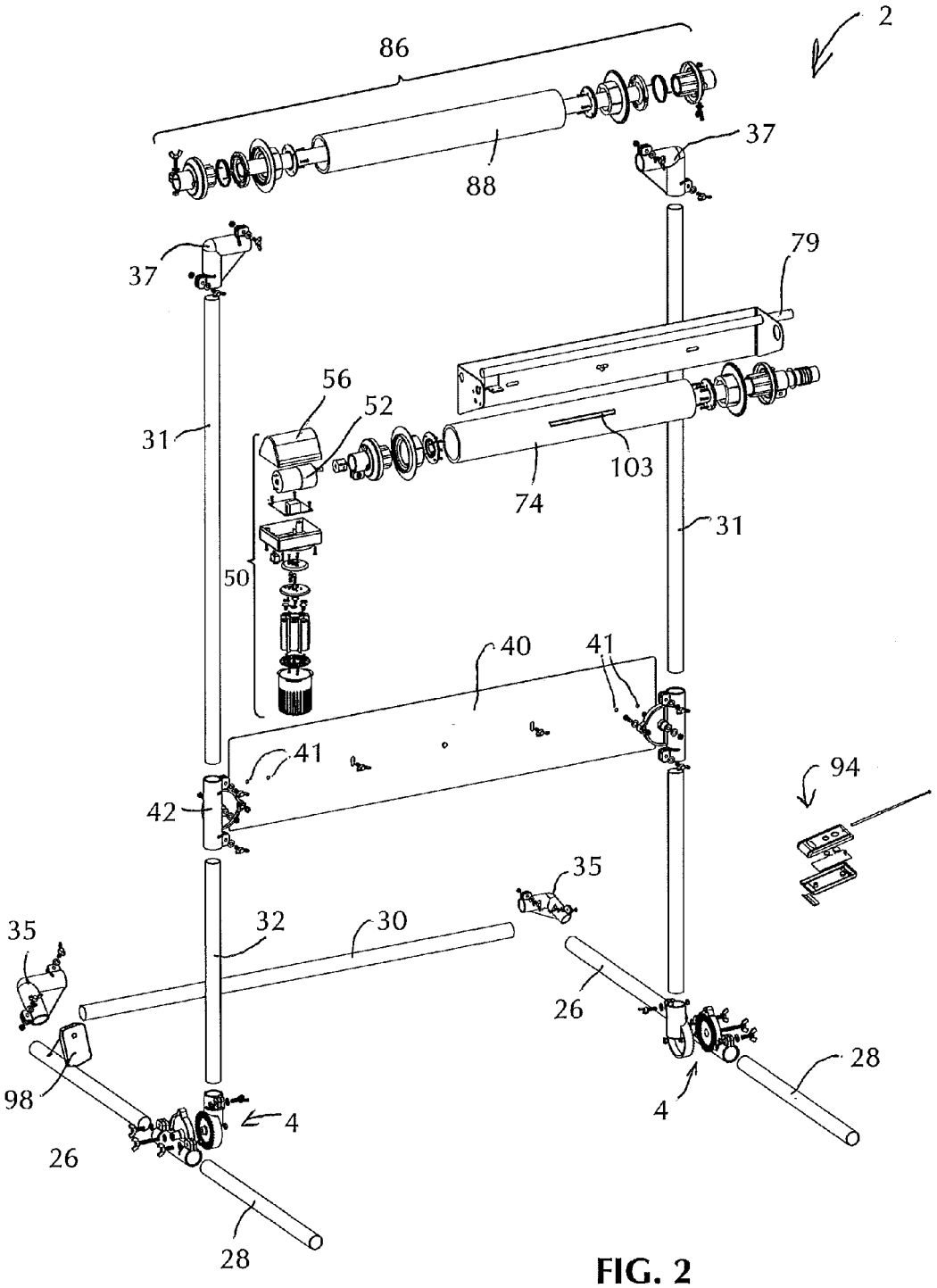
FIG. 2 is a rear exploded perspective view of the target holder shown in FIG. 1.
Figure 3:
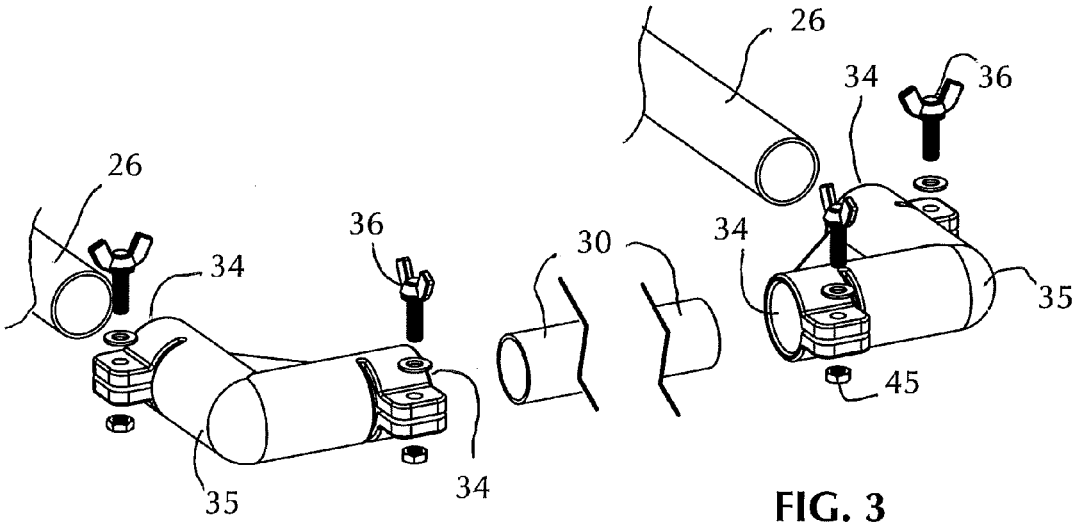
FIG. 3 is a perspective view of the target holder lower elbows according to the present invention.

The target stand 2 as shown in the front view of FIG. 1 and a rear exploded view of FIG. 2 includes a frame having a horizontal support assembly including a cross support rod 30 having ends, front support rods 26 extending forward at about right angles to the cross support rod 30 and attached to the cross support rod ends by a lower elbow 35. As shown in FIG. 3, the lower elbows 35 includes lower elbow opening 34 on each end of the lower elbow 35 slidably engagable with the cross support rod 30 and the front support rods 26. A level adjustment assembly 4 is attached to the end of the front support rod 26 opposite the front support rod end connected to the lower elbow 35. Rear support rods 28 are connected to the opposite end of the level adjustment assembly 4.

Figure 4:
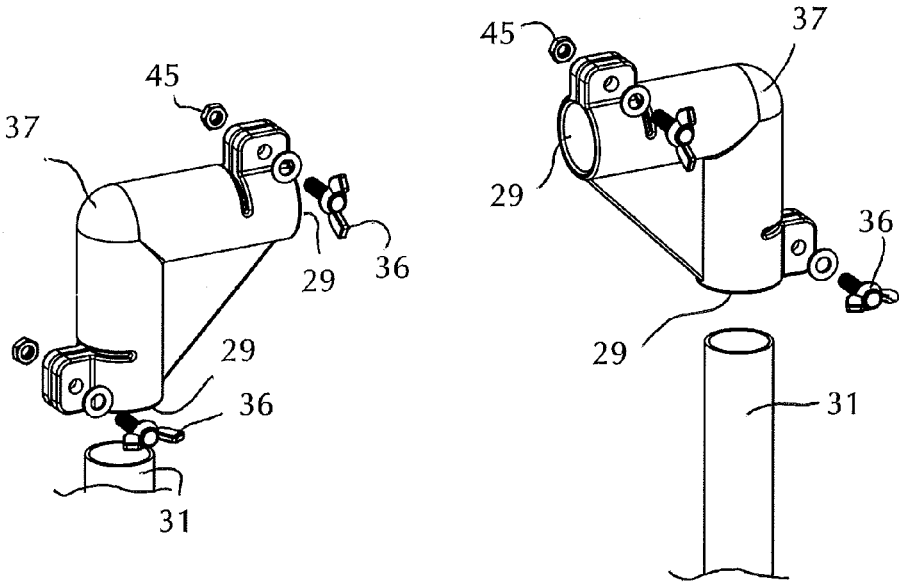
FIG. 4 is a perspective view of the target holder upper elbows according to the present invention.
Figure 5:
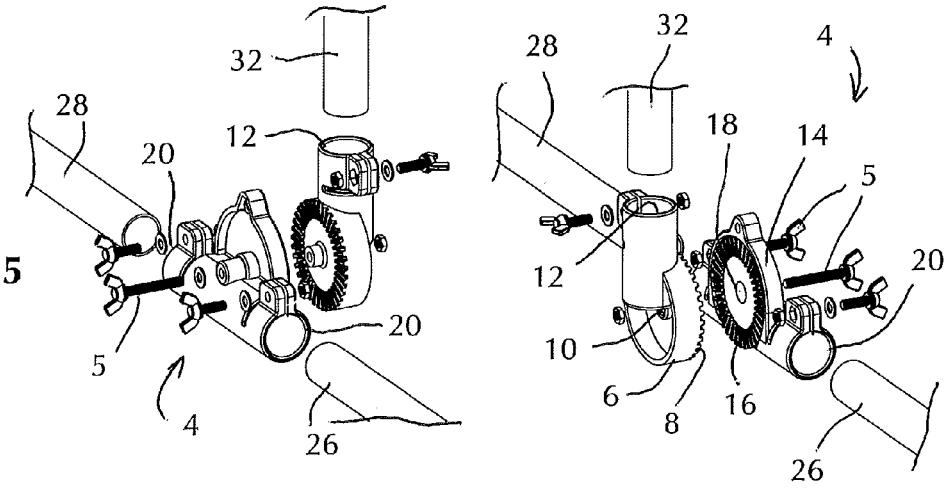
FIG. 5 is a perspective view of the target holder level adjustment assemblies according to the present invention.

The frame includes a vertical support assembly attached to the horizontal support assembly at about a right angle. The vertical support assembly includes a vertical frame lower member 32 and a vertical frame upper member 31 connected in line with a motor support member 42. The vertical support assembly includes upper elbows 37 as shown in FIG. 4. Upper elbows 37 have upper elbow openings 29 engagable with vertical frame upper member 31 and upper connectors 23 at about right angles to the corresponding vertical frame upper member 31. The vertical support assembly is adjustably attached to the horizontal support assembly by a level adjustment assembly 4. The level adjustment assembly shown in FIG. 5 includes a vertical adjustment disc 6 having vertical adjustment disc teeth 8 adjacent the vertical adjustment disc perimeter and a vertical adjustment disc opening 10. A level assembly vertical opening 12 is engagable with the vertical frame lower members 32 and level assembly horizontal openings 20 are engagable with front support rods 26 and rear support rods 28. The level adjustment assembly 4 includes a horizontal adjustment disc 14 having horizontal adjustment disc teeth 16 adjacent the horizontal adjustment disc perimeter and a horizontal adjustment disc opening 18. The horizontal adjustment disc teeth 16 are engagable with the vertical adjustment disc teeth 8 when the vertical adjustment disc 6 and the horizontal adjustment disc 14 are attached using a level adjustment assembly fastener 5 through the vertical adjustment disc opening 10 and the horizontal adjustment disc opening 18. The openings of the upper elbows 37 and lower elbows 35 may be secured to the corresponding rods with threaded fasteners 36, the threaded fastener 36 rotation contracting the upper and lower elbow openings 29, 34.

The target holder 2 includes a plurality of targets 100 on a target roll 99. The targets 100 may be paper, flashspun high-density polyethylene fibers, vinyl, plastic or the like. The target may additionally have a protective coating to make the target more durable.

Figure 6:
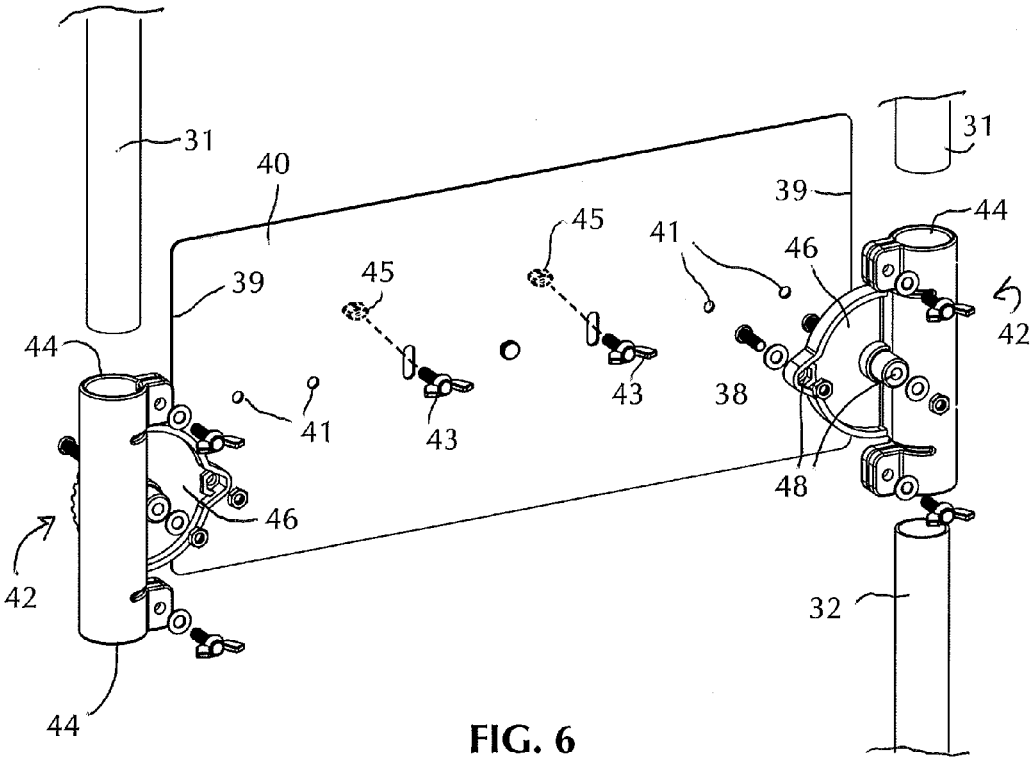
FIG. 6 is a perspective view of the motor support member and motor support connectors according to the present invention.
Figure 7:
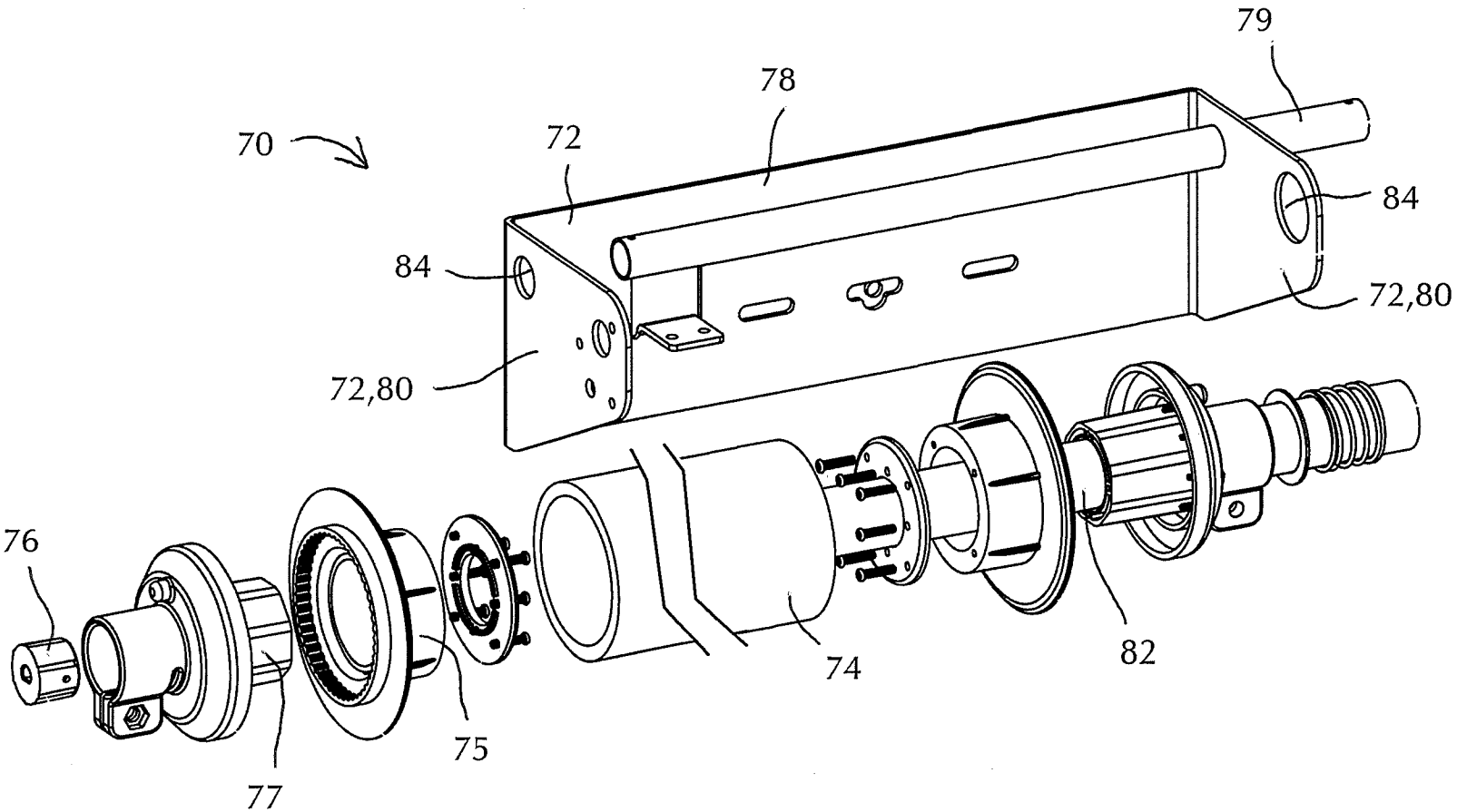
FIG. 7 is an exploded view of the take-up roll assembly according to the present invention.

FIG. 6 shows a motor support member 40 including opposing motor support sides 39, each side attached to a motor support connector 42. The motor support member 40 supports the take-up roll assembly 70 shown in FIG. 7 and protects the take-up roll assembly 70 from projectiles moving toward the take-up roll assembly 70. The motor support member 40 includes motor support member openings 41 for attaching the motor support member 40 to the take-up roll assembly 70 and motor support connectors 42. Motor support fasteners 43 extend through the motor support member openings 41 and motor support connector 42 or take-up roll assembly 70. Threaded nuts 45 may engage the motor support fasteners 43 for securing the motor support connector 42 or take-up roll assembly 70 to the motor support member 40 in FIG. 6.

The motor support connectors 42 include a motor support connector openings 44 and a support connector member 46 extending from the motor support connector opening 44 toward the opposing motor support connector 42. The support connector member 46 may include support connector member openings 48 for connector plate fasteners 38 extending through the support connector member openings 48 and motor support member openings 41 corresponding with the support connector member openings 48. Motor support fasteners 43 may attach the motor support member 40 to the take-up roll assembly 70 in FIG. 7. Upper frame vertical members 31 extend through an upper portion of the motor support connector opening 44 and lower frame vertical members 32 extend through a lower portion of the motor support connector opening 44. The motor support connector openings 44 may be secured to the corresponding rods with threaded fasteners 36, the threaded fasteners 36 rotation contracting the motor support connector openings 44. The take-up roll assembly 70 shown in FIG. 7 includes a take-up tube support bracket 72 having a rear bracket member 78 and side bracket members 80. The side bracket member 80 may extend substantially perpendicular from the rear bracket member 78, parallel to one another and may include a bracket opening 84. The take-up roll assembly 70 includes a take-up tube 74, an inside tube support 75 at each end of the take-up tube 74 and a lower axel 82 extending from one inside tube support 75 to the opposite inside tube support. The take-up roll assembly 70 may include a drive shaft coupler 76 attachable to the drive shaft 54 of the motor 52 and a coupler adapter 77 for connecting the drive shaft coupler 76 to the inside tube support 75.

Figure 8:
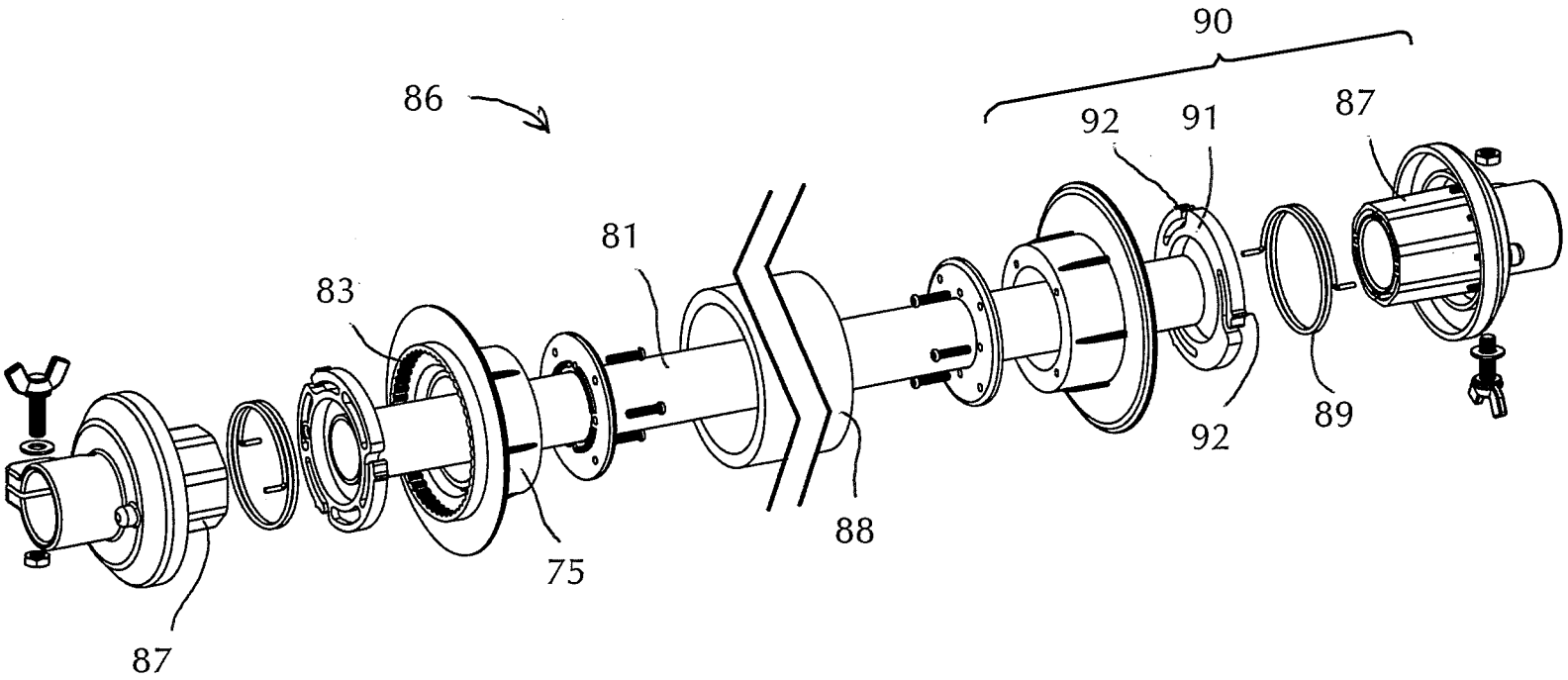
FIG. 8 is an exploded perspective view of the supply roll assembly according to the present invention.

FIG. 8 shows the supply roll assembly 86 which includes an upper axel 81 engagable with upper elbows 37. The supply roll assembly 86 includes a pair of inside tube supports 87 engagable in the supply roll 88, a clutch plate 91 and a clutch spring 89 engagable with the clutch plate 91 and tube support 87 at each end of the clutch spring 89. Clutch teeth 92 are urged against inside tube support teeth 83 disposed on an inner portion of the inside tube support 75. The clutch teeth 92 allow rotational pressure to be exerted on the supply roll 88 without allowing movement of the supply roll 88, but continuing to increase the rotational pressure will disengage the clutch teeth 92 from the inside tube support teeth 83, allowing rotation of the supply roll 88 for advancing the target roll 99.

Figure 9:
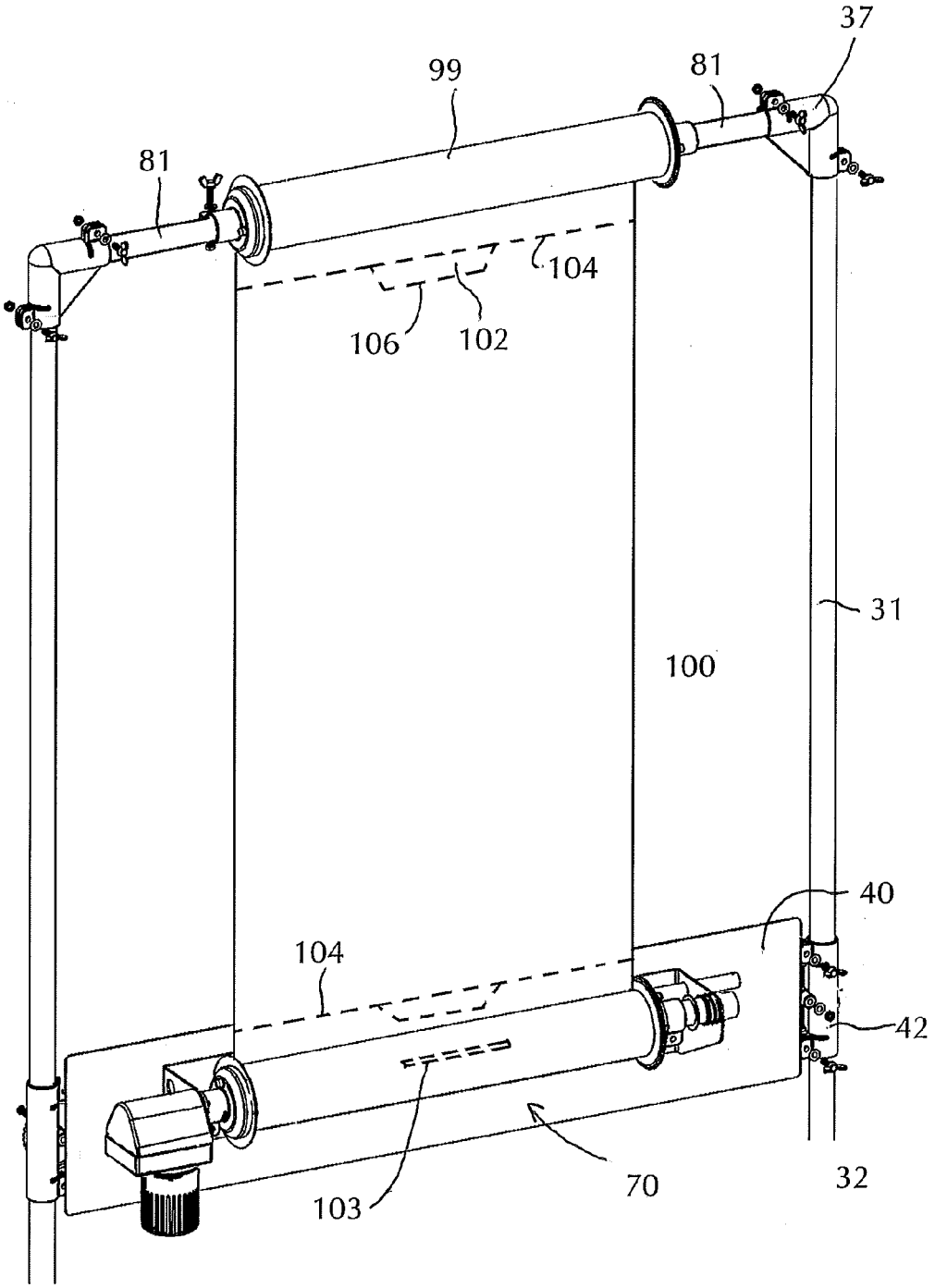
FIG. 9 is a rear perspective view of the target assembly according to the present invention.

FIG. 9 shows the supply roll assembly 86 with the take-up roll assembly and the target roll 99 attached to the upper portion of the vertical frame assembly. The target roll may include horizontal perforations 104 extending across the width between adjacent targets, the horizontal perforations 104 allowing a user to separate the exposed target 100' from the target roll 99. The target holder may include a tab 102 disposed on the target roll 99 and an elongated slot 103 disposed on the take-up roll 74, the tab 102 engagable with the elongated slot 103 for allowing a user to insert the tab 102 into the elongated slot 103 during set up of the target holder. The target roll 99 includes tab perforations 106 between adjacent targets, the tab perforations 106 allowing a user to separate the exposed target 100' targets from the target roll 99 while leaving a tab 102 on the target roll, the tab 102 insertable into the elongated slot 103 of the take-up roll 74. Alternately, the target may include an adhesive to fasten to the take-up roll 74. The adhesive may be disposed on the first target 100 on the supply roll 99 or on each of the targets 100 on the supply roll 99.

Figure 10:
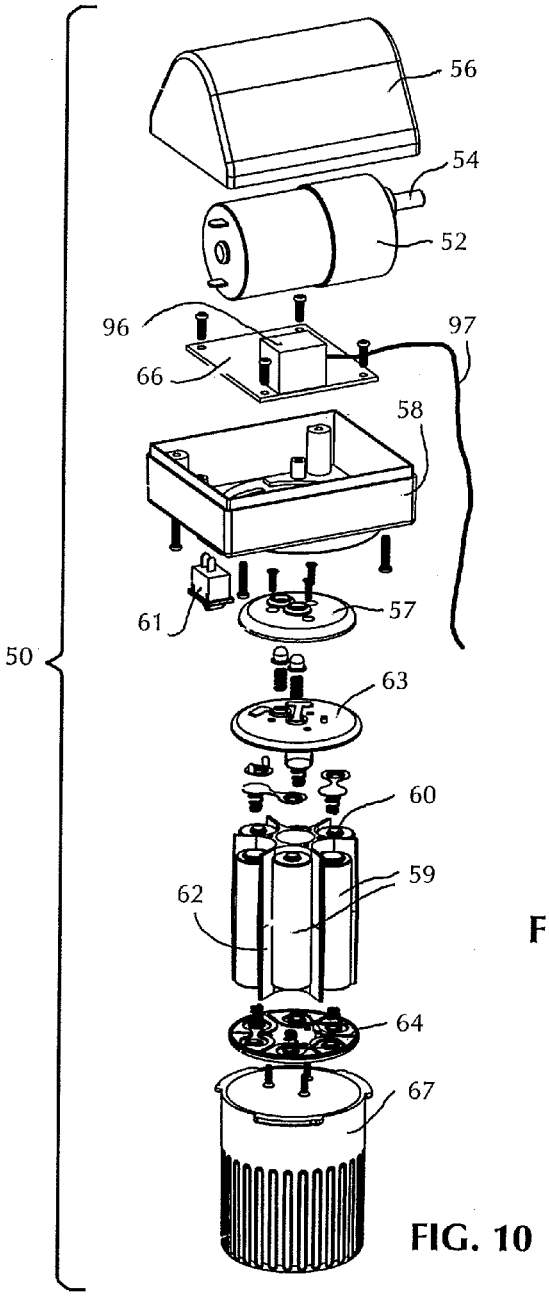
FIG. 10 is an exploded view of the motor assembly according to the present invention.
Figure 11:
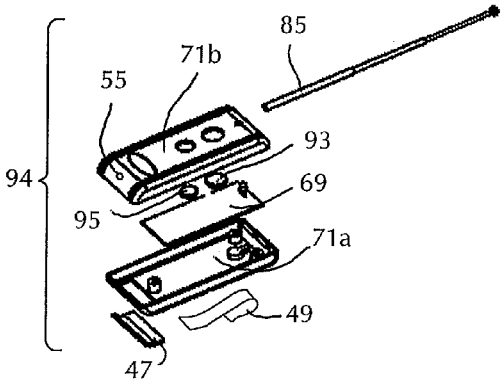
FIG. 11 is an exploded perspective view of the remote transmitter according to the present invention.

The motor assembly 50 shown in FIG. 10 includes a motor tray 58, a motor 52 having a drive shaft 54 which rotates when power is applied to the motor 52 and a motor cover 56 attachable to the motor tray 58. The motor cover 56 may seal against the motor tray 58 to protect the motor 52 from moisture and debris, the motor 52 disposed between the motor tray 58 and the motor cover 56. The motor assembly 50 includes batteries 59 disposed within a battery cover 67 and a battery separator 62 having fins 65 which prevent the batteries 59 from contacting one another. The motor assembly 50 includes an upper contact plate 63 and a lower contact plate 64 having upper and lower contacts respectively. The upper and lower contact plates 63, 64 provide connections to the battery terminals 60 so the batteries 59 may deliver the correct voltage and current to the motor 52. An adapter plate 57 is attached to the upper contact plate 63 to secure the battery cover 67 to the motor tray 58. A switch 61 disposed on the motor tray 58 provides control for the power generated from the batteries 59. When the switch 61 is in the on position, electrical power is allowed to a motor control circuit 92 and when the switch 61 is in the off position, electrical power is not allowed to the motor control circuit 92. The motor control circuit 92 may include an auto shut off As shown in FIG. 11, the target holder 2 may include a remote transmitter 94 and a corresponding remote receiver 96 in communication with the motor control circuit 92. The remote transmitter 94 may include an advance button 93 for initiating the advancement of the target roll 99. A stop button 95 for terminating the advancement of the target roll 99 may be included on the remote transmitter 94. A pairing button 55 may be included to pair or match the transmitter 94 to the receiver 96 during initial set-up of the target holder 2. The remote transmitter 94 may include a transmitter circuit board 69, at least one battery 59 to power the transmitter circuit board 66, a battery cover 67 attachable to a lower transmitter case portion 71*a* and an upper transmitter case portion 71*b* fastenable to the lower transmitter case portion 71*a*. An antenna 85 may be attached to the remote transmitter 94 for transmitting radio frequency signals. Alternatively, an infrared lamp may be attached to the remote transmitter for transmitting infrared signals. A transmitter clip 49 may be attached to the transmitter 94. The transmitter clip may be used for attaching the transmitter 94 to a belt, article of clothing or other items. The remote transmitter 94 may transmit the advancement signal on an infrared carrier, radio frequency carrier or any medium which transmits a signal from one point to another.

The individual targets 100 on the target holder 2 may include a stop indicator mark 101 and the target holder 2 may include an optical sensor 68 for sensing the stop indicator mark 101 on the target 100. The stop indicator mark 101 may be positioned on the target 100 such that, in advancing the targets 100, the optical sensor 68 sends a stop signal to the motor control circuit 66 when the stop indicator mark 101 moves to a position adjacent to the optical sensor 68. The stop signal received by the motor control circuit 92 stops the motor drive shaft 54 from rotating and stops the target advancement.

The target roll 99 may include target perforations 104 between each target 99 so removal of a target 99 may be performed neatly.

The take-up tube 74 may include an elongated slit 103 for engaging a target tab 102 disposed at the beginning of each roll of targets. The target tab 102 may be inserted into the elongated slit 103 in the take-up tube 74 during initial set up of the target holder 2. Additionally, each target 100 may include a target tab 102 which may be perforated and integral with the previous target so the target tab 102 may be left on the first unused target 100 in the target roll 99 when the target holder is broken down or when the previous target has been removed during the previous session.

The supply roll assembly 86 includes an upper axel 81 and a supply roll clutch 90 on at least one end of the supply tube 88. A supply roll clutch 90 may be disposed at each end of the upper axel 81. The supply roll clutch 90 includes a clutch plate 91, clutch spring 89 having one end engagable with the clutch plate 91 and an opposite end attachable to a spring engagement member 87 attached to an end of the upper axle 81.

As shown in the exploded view, the target holder 2 may include a remote camera 98 disposed on the frame 22. The remote camera 98 may send a visual display signal to a visual receiver so the user can see the target 100, and more specifically can see the close-up view of the target 100 after the ammunition rounds have perforated the target.

A cell phone may be used to provide a signal for advancement of the target roll. A cell phone camera may be used to transmit an image of the target to a display. Alternately, a pair of cellular phones may be used, one to capture an image of the target located at the target holder and the other to display the image at the firing location.

The target holder 2 may include a target holder cover for protecting the target holder from the sun, rain, snow or other weather related elements.

The target holder 2 may include a back portion to stop a projectile from continuing its flight path. The back portion may be metal, dense foam or other material and may collect the projectiles for disposal or recycling.

Figure 12:
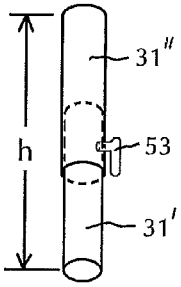
FIG. 12 is an alternate embodiment of the vertical frame upper members according to the present invention.
Figure 13:
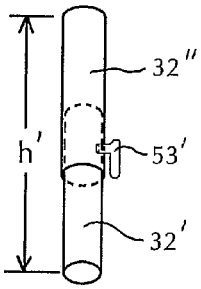
FIG. 13 is an alternate embodiment of the vertical frame lower members according to the present invention.

FIG. 12 shows an alternate embodiment of the vertical frame upper member 31 shown in FIG. 1. A male vertical frame upper member 31' may include a tightening handle 53 for adjustably securing a female vertical frame upper member 31" into the male vertical frame upper member 31'. By loosening the handle 53, extending or retracting the male vertical frame upper member 31' within the female vertical frame upper member 31" and tightening the handle 53, the height h may be changed to adjust the position of the target roll 99. Likewise, FIG. 13 shows an alternate embodiment of the vertical frame lower member 32 shown in FIG. 1. A male vertical frame lower member 32' may include a tightening handle 53' for adjustably securing a female vertical frame lower member 32" into the male vertical frame lower member 32'. By loosening the handle 53', extending or retracting the male vertical frame lower member 32' within the female vertical frame lower member 32" and tightening the handle 53', the height h' may be changed to adjust the position of the target roll 99 and the take-up roll assembly 70.

In a method for using a target holder, a user ensures one of the plurality of targets is disposed between the supply roll assembly and the take-up roll assembly. The user then fires at least one round of ammunition toward the target pressing the start button on the remote transmitter to send a signal to the remote receiver, commencing the operation of the motor. The motor may be stopped by pressing the stop button or waiting for the next target to fully become positioned between the take-up roll and the target roll wherein the motor control circuit automatically stops the progression of the take-up roll by allowing the optical sensor to sense the indicator mark on a second target.

While the present invention has been particularly described, in conjunction with a specific preferred embodiment, it is evident that many alternatives, modifications and variations will be apparent to those skilled in the art in light of the foregoing description. It is therefore contemplated that the appended claims will embrace any such alternatives, modifications and variations as falling within the true scope and spirit of the present invention.

Thus, having described the invention, what is claimed is:

1. A target holder comprising:

a frame including a vertical frame assembly having a left side member and a right side member, and a horizontal frame assembly connected to a bottom portion of the vertical frame assembly;

a supply roll assembly disposed along a top portion of the vertical frame assembly;

a motor support disposed on the vertical frame assembly elevated above the horizontal frame assembly, below the supply roll assembly, and traversing from said left side member of said vertical frame assembly to said right side member of said vertical frame assembly;

a motor having a rotatable drive shaft, the motor fastened to the motor support assembly;

a take-up roll assembly rotatingly engaged with the drive shaft;

a target roll rotatingly disposed on the supply roll assembly, the target roll including a plurality of targets; and a tab disposed on the target roll and an elongated slot disposed on the take-up roll assembly, the tab engagable with the elongated slot for allowing a user to insert the tab into the elongated slot during set up of the target holder, wherein the target roll has a width and tab perforations extending across the width between adjacent targets, the tab perforations allowing a user to separate at least one of the plurality of targets from the target roll while leaving the tab on the target roll, the tab insertable into the elongated slot of the take-up roll.

2. The target holder of claim 1 including a motor control circuit connected to the motor, the motor control circuit controlling operation of the motor.

3. The target holder of claim 2 including a remote receiver and a remote transmitter, the remote receiver in communication with the motor control circuit and receiving a signal transmitted by the remote transmitter.

4. The target of claim 2 wherein each of the targets include an indicator mark disposed thereon and the motor control circuit includes an optical sensor sensing the position of the indicator mark.

5. The target of claim 4 wherein the target is advanced forward and the optical sensor causes termination of roll advancement when the indicator mark is adjacent to the optical sensor.

6. The target holder of claim 1 including a camera capturing a visual image of at least one target and transmitting the visual image signal to a display.

7. The target holder of claim 1 wherein the frame includes a level adjustment assembly having a horizontal adjustment disk attached along the horizontal assembly and a vertical adjustment disk attached along the vertical frame assembly, the vertical adjustment disk having a first set of teeth along the perimeter of the vertical adjustment disk and the horizontal adjustment disk having a second set of teeth along the perimeter of the horizontal adjustment disk, the second set of teeth engagable with the first set of teeth whereby the vertical frame assembly is angularly adjustable in relation to the horizontal frame assembly.

8. The target holder of claim 1 wherein the motor support assembly includes a motor bracket attached to the vertical frame assembly, the motor bracket including a pair of opposing side brackets having bracket openings.

9. The target holder of claim 1 wherein the supply roll assembly includes a clutch for providing rotational resistance to the supply roll assembly.

10. The target holder of claim 1 wherein the target roll has a width and horizontal perforations extending across the width between adjacent targets, the horizontal perforations allowing a user to separate at least one of the plurality of targets from the target roll.

11. The target holder of claim 1 including:

a motor control circuit connected to the motor, the motor control circuit controlling operation of the motor, a remote receiver and a remote transmitter, the remote receiver in communication with the motor control circuit and receiving a signal transmitted by the remote transmitter, wherein each of the targets include an indicator mark disposed thereon and the motor control circuit includes an optical sensor sensing the position of the indicator mark.

12. The target holder of claim 11 wherein the motor control circuit commences advancement of the target roll upon receiving a signal from the remote transmitter.

13. The target holder of claim 12 wherein the optical sensor causes termination of the roll advancement when the indicator mark is adjacent to the optical sensor.

14. A target holder comprising:

a frame including a vertical frame assembly and a horizontal frame assembly connected to a bottom portion of the vertical frame assembly and a level adjustment assembly having a horizontal adjustment disk attached along the horizontal assembly and a vertical adjustment disk assembly attached along the vertical frame assembly, the vertical adjustment disk having a first set of teeth along the perimeter of the vertical adjustment disk and the horizontal adjustment disk having a second set of teeth along the perimeter of the horizontal adjustment disk, the second set of teeth engagable with the first set of teeth whereby the vertical frame assembly is angularly adjustable in relation to the horizontal frame assembly;

a supply roll assembly disposed along a top portion of the vertical frame assembly;

a motor support disposed on the vertical frame assembly below the supply roll assembly;

a motor having a rotatable drive shaft, the motor fastened to the motor support assembly;

a take-up roll assembly rotatingly engaged with the drive shaft; and a target roll rotatingly disposed on the supply roll assembly, the target roll including a plurality of targets.

* * * * *